United States Patent [19]

Matsuda

[11] Patent Number: 4,903,797

[45] Date of Patent: Feb. 27, 1990

[54] APPARATUS FOR ESCAPING FROM BUILDING ON FIRE

[76] Inventor: Masako Matsuda, 1-6-5, Shinkadokawa, Uozu, Toyama-ken, Japan

[21] Appl. No.: 325,188

[22] Filed: Mar. 17, 1989

[51] Int. Cl.[4] ..... A62B 1/02

[52] U.S. Cl. ..... 182/142; 182/231

[58] Field of Search ..... 182/142, 74, 231, 236, 182/73

[56] References Cited

U.S. PATENT DOCUMENTS

| | | | |
|---|---|---|---|
| 481,888 | 8/1892 | Bergeron | 182/142 |
| 484,536 | 10/1892 | Leber | 182/142 |
| 649,966 | 5/1900 | Thompson | 182/142 |
| 689,703 | 12/1901 | Brown | 182/236 |
| 727,237 | 5/1903 | Ward | 182/142 |
| 967,518 | 8/1910 | Hartmann | 182/142 |
| 1,027,724 | 5/1912 | Haney | 182/142 |
| 1,191,790 | 7/1916 | Hunter | 182/236 |
| 3,978,942 | 9/1976 | Jimenez | 182/142 |
| 4,520,900 | 6/1985 | Orgeon | 182/142 |
| 4,674,599 | 6/1987 | Nelson | 182/231 |

*Primary Examiner*—Reinaldo P. Machado
*Attorney, Agent, or Firm*—Edwin E. Greigg

[57] ABSTRACT

The present invention relates to an apparatus for escaping from a building on fire. The apparatus comprises a body frame with a gondola, a pin-wheel, a rolling drum, an anchor, a weight, an inside and out side blocks, a projection and a pair of stoppers so that the anchor may be swung and stopped to control the speed of a descending gondola.

7 Claims, 3 Drawing Sheets

APPARATUS FOR ESCAPING FROM BUILDING ON FIRE

BACKGROUND OF THE INVENTION (1) Field of the Invention

The present invention relates to an apparatus for escaping from a building on fire, by which a large number of suferers boarding on a gondola may safely go down when a building is burnt.

(2) Description of the Prior Art

It has been required that an apparatus of this type can control a descending speed against a load such as suferers taken on a gondola and the weight of the gondola. It has been proposed to use a brake device as said control mechanism. The brake device has a difficulty in controlling the speed and the speed easily increases. Further, an accident resulting from a frictional heat is apt to take place.

So, the present inventor has proposed an apparatus adopting a so-called escape mode (Japanese Patent Application No. Sho. 62-171687) to solve the problems.

The apparatus according to said Japanese Patent Application is basically similar to one shown as a preferred embodiment. A pin-wheel and an anchor were pivoted on a body to be descended and an upper guide block and a lower guide block for receiving pin-rollers rollers to turn by the anchor and escaping them were alternately disposed to control a rotation of a rolling drum rotated integrally with the pin carriage.

With the above described apparatus of escape mode, if the upper guide block is pressed down by a descending force resulting from the rotation of the pin-roller, the anchor is swung toward one direction by a component of force in an inclined direction of the guide block, while, if the pin-roller is fallen from the upper guide block to the lower guide block by the swing of the anchor, the swing of the anchor is stopped and the anchor is swung in an opposite direction by a component of force pressing the lower guide block. That is to say, the swing of the anchor is carried out by the component of force in the inclined direction of the upper guide block and the lower guide block to control the rotation of the pin carriage and the rolling drum. Accordingly, the apparatus of escape mode according to Japanese Patent Application No. Sho. 62-171687 exhibited a remarkably increased controlling capacity in comparison with the apparatus of friction mode. In addition, there was not the possibility of accident due to the frictional heat at all.

However, if the load is excessively increased, also a component of force is excessively increased, also a component of force is increased in proportion to the load, so that the swinging range of the anchor is excessively increased, whereby the anchor is drawn into the pin-wheel, and thus it is difficult to stably control the descending speed. In addition, a problem had occurred in that it is difficult to maintain an appointed suitable speed although slightly in comparison with the case of friction mode.

SUMMARY OF THE INVENTION

It is an object of the present invention to provide an apparatus capable of always and continuously maintaining a descending speed constant and starting and stopping the descent by a remarkably light operation of a lever regardless of a load in view of the above described actual circumstances.

In order to achieve the above described object, the apparatus for escaping from a building on fire according to the present invention comprises a body provided with a gondola, a pin-wheel rotatably pivoted on said body and provided with a plurality of pin-rollers projected in the vicinity of an outer circumferential edge of at least one side thereof at appointed intervals in a circumferential direction so as to be rotatable around an axis shaft line parallel to an axis of rotation thereof, a rolling drum disposed integrally with said pin-wheel, a rope for hanging said body being wound around said rolling drum, an anchor hung down under the condition that one side thereof is closer to said pin-roller so as to be swingable around an axis shaft line parallel to the axis of rotation of said pin-wheel above said pin-wheel, a weight disposed on a lower end side of said anchor, an inside guide block disposed so as to be positioned on a rotation locus of said pin-roller on a side surface facing to said pin-wheels under the condition that said anchor is swung and stopped, an outside guide block disposed outside in a radial direction of said inside guide block so as to be positioned on the rotation locus of said pin-wheels under the condition that the swing of said anchor is stopped and goes off the rotation locus when said anchor is swung in the direction going away from the rotation axis shaft line of the pin-wheel, a projection projected outward from an outside edge of an almost middle portion in the circumferential direction of said anchor, and a pair of stoppers disposed on a movement locus of said projection so as to control a swinging amplitude of said projection.

Accordingly, with the above described construction, when the body provided with a gondola installed on an appointed stair and the roof of a building and the like is descended during a fire, the following operation is conducted.

That is to say, when the suferers get on the body provided with the gondola hung down by means of the hanging rope and descended, the hanging rope is rewound to rotate the rolling drum counterclockwise. Thereupon, the pin carriage integrated with the rolling drum starts to rotate from a stop position thereof (hanging down position by its own weight), whereby a plurality of pin-rollers, which are projected from this pin-wheel at appointed intervals, start to rotate. In this time, although the inside and outside guide blocks of the anchor are positioned on the movement locus of said pin-wheel, one of the pin-roller closest to the outside guide block presses a surface of this outside guide block downward to swing the anchor clockwise by a component of force. Thereupon, an end portion of said outside guide block goes off the rotation locus of said pin-roller to be set free, whereby being rotated and moved. With this, a pin-roller on a downstream side in a rotating direction (positioned on an upper side in the drawing) is moved to be received by the inside guide block of the anchor which is being moved clockwise by an inertia. A force is generated in an opposite direction to revolve the anchor counterclockwise due to the said inside guide block when the inside guide block is engaged with the pin-roller and this force acts at first as a force braking the rotation of the pin-wheel. Thus, the swinging direction of the anchor is converted. And, if the rotation of said pin-wheel is continued, a pin-roller which is engaged with said inside guide block, presses this inside guide block downward. As a result, the inside guide block generates a component of force which leads to the swing of the anchor counterclockwise. In this time, since the inside guide block is positioned in the vicinity of the rotation center of the anchor, if it is intended to rotate the anchor by means of the pin-roller, which is engaged with this inside guide block, a large force is required. In other words, since a large reaction force acts upon the pin-roller, the rotation of the pin-wheel, which is integrated with the pin-roller is braked, whereby the braking action for the pin-wheel is achieved. And, if the counterclockwise swing of the anchor, that is the swing of the anchor approaching to the rotation axis of shaft line of the pin-wheel makes progress by an appointed range, the pin-roller, which is engaged with this inside guide block, goes off an end portion of this inside guide block to freely rotate downward, whereby permitting the pin-wheel to rotate by the appointed angle of rotation.

During the rotation of this pin-wheel by the appointed angle of rotation, said anchor intends to continue the swing by its inertial force. But, the pin-roller, which has gone off the end portion of said inside guide block to be set free in downward rotation, arrives at the outside guide block to be received by it. The outside guide block leads to the generation of a component of force rotating the anchor clockwise this time. That is to say, here it is intended to stop an inertial swing of the anchor and swing it in an opposite direction. In short, the inertial force of the anchor becomes a braking force preventing the pin carriage from being rotated as seen from the side of the pin-rollers.

Thus, the reciprocal swing of the anchor within the appointed range can give the braking action to the pin-wheel.

As above described, with the apparatus for escaping from a building on fire according to the present invention, the very stabilized and constant descending speed can be maintained from the start of the descending to the finish of the descending. In addition, the swinging range of the anchor is limited by both stoppers, so that no trouble due to a runaway of the anchor occurs, whereby the safe descending can be secured.

In addition, in the case where means for restraining the operation of the anchor and an operating lever are used, the descending can be started by the operation drawing the operating lever and can be stopped by the action separating a hand from the lever, so that the operation is remarkably simple. Accordingly, a superior effect is exhibited in that no misoperation is done even by ladies and children who are weak in knowledge of machineries, whereby the safe apparatus including a gondola can be secured.

Other advantages of the present invention will be more obvious from the following description with reference to the drawings.

BRIEF DESCRIPTION OF THE DRAWINGS

One preferred embodiment of an apparatus for escaping from a building on fire according to the present invention is shown in the drawings, in which.

DETAILED DESCRIPTION OF THE EMBODIMENTS

Figure 1:
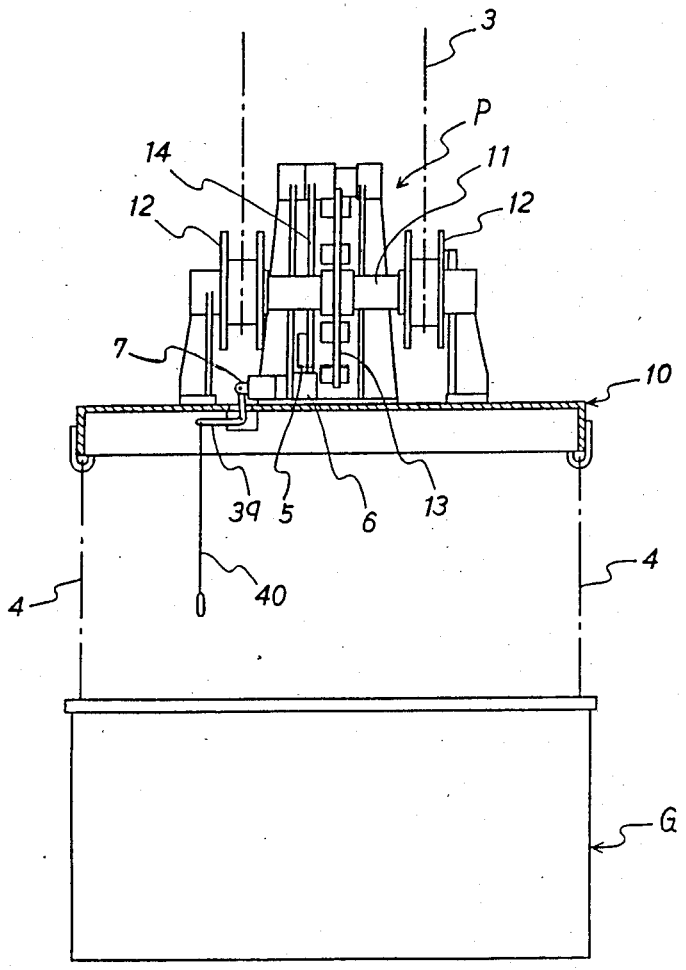
FIG. 1 is a side view showing an essential portion of the apparatus.
Figure 2:
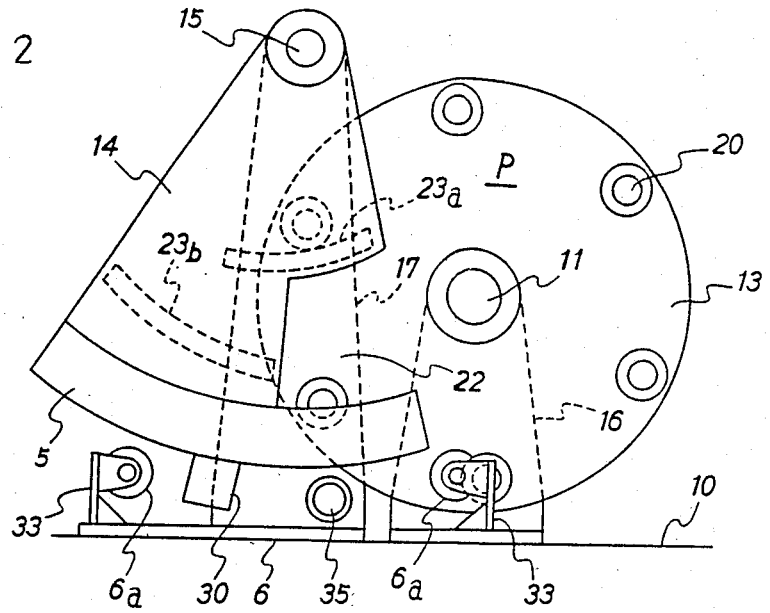
FIGS. 2 and 3 are front views showing principal parts of the descending apparatus in an order of operation.
Figure 3:
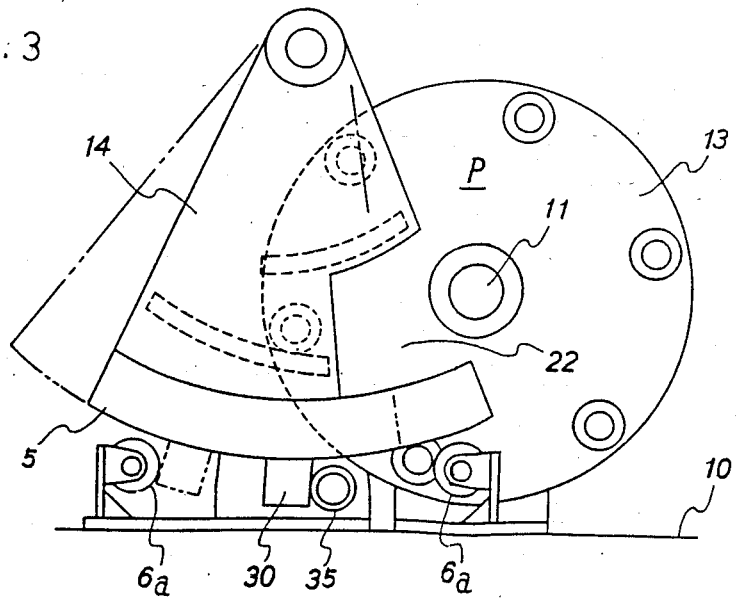
Figure 4:
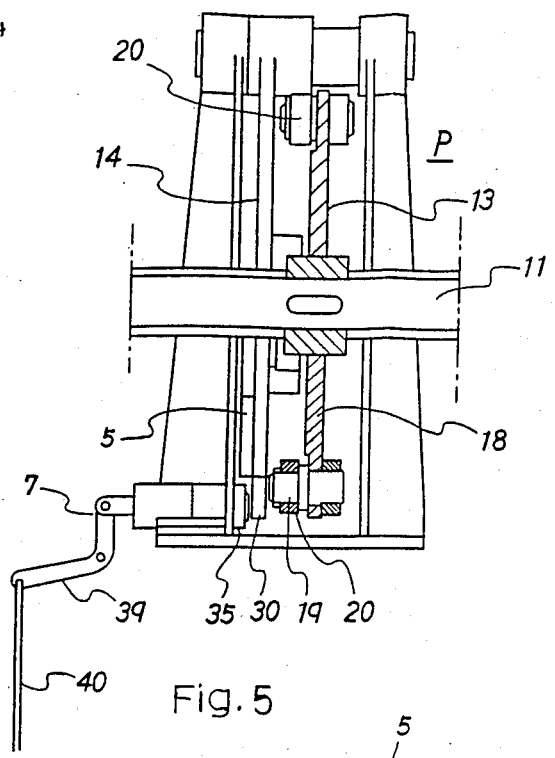
FIG. 4 is a sectional side view of the apparatus in FIG. 2.
Figure 5:
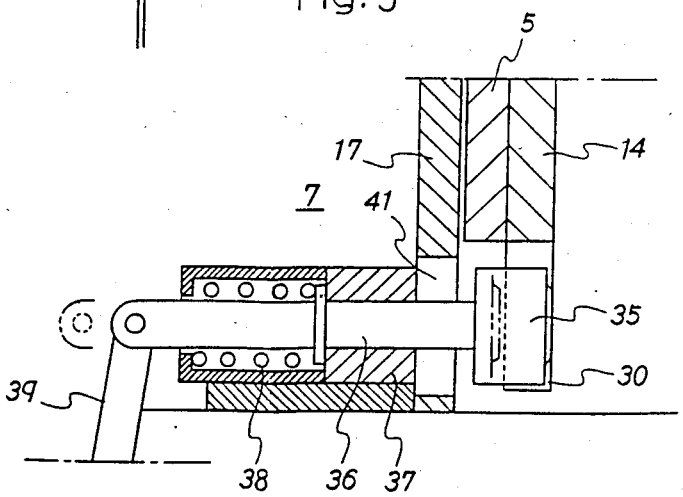
FIG. 5 is an enlarged sectional view showing a handle mechanism.

Referring now to the drawings showing one preferred embodiment, an apparatus for escaping from a building on fire comprises a gondola G hung from a body frame 10 provided with a controller P, said controller P comprising a weight 5, an amplitude-controlling device 6, a handle mechanism 7 and the like characterizing the present invention in addition to a controlling shaft 11, a rolling drum 12, a pinwheel 13 and an anchor 14.

The body frame 10 is a base of the controller P on which a hanging chain 4 of the gondola G is hung. In addition, the body frame 10 is provided with a pair of right and left shores 16, 16 for supporting the controlling shaft 11 and a pair of right and left shores 17, 17 for supporting an anchor shaft 15 standing from an upper surface thereof.

The controlling shaft 11 is provided with the rolling drums 12, 12 integrally mounted on both ends thereof between both shores 16, 16 and the pin-wheel 13 integrally mounted on a middle portion thereof.

The pin-wheel 13 is provided with 6 pieces of pin shaft 19 projected on one surface of a disk 18 at equal intervals along an outer circumferential edge portion of the disk 18, said pin shafts 19 being provided with pin-roller 20 rotatably pivoted thereon.

The anchor 14 is pivoted on the anchor shaft 15 so as to be swingable facing to the pin-wheel 13. As to the shape, the anchor 14 is almost semicircular but is provided with a notched portion 22 in a middle portion on the side of the controlling shaft 11 so as to prevent the collision with the controlling shaft 11 and a projection 30 in a central portion of a lower end thereof. In addition, the anchor 14 is provided with an upper guide block **23*a* and a lower guide block 23*b* projected in the middle portion thereof for receiving the pin-roller 20 on the way of their descent and the weight 5 mounted along a semicircular end edge in a lower end portion thereof. The upper and lower guide blocks 23*a* and 23*b* may be formed substantially straight or curved gently so as to obtain a great component of force for swinging the anchor 14**.

As to the fitting of both guide blocks **23*a*, 23*b*, the the upper guide block 23*a* is disposed on the side of the controlling shaft 11 and the lower guide block 23*b* is disposed on the side opposite to the upper guide block 23*a*** so that they may be alternately disposed. In addition, they both are inclined so as to be lower in the alternate directions.

The amplitude-controlling device 6 comprises stoppers **6*a*, 6*a* for the projection 30 provided at both ends within the swinging range of the projection 30 of the anchor 14, said stoppers 6*a*, 6*a* being formed of rubbery elastic materials suitable for the noise suppression in the form of roller and pivoted on an upper end portion of a standing plate 33 fixedly mounted on the body frame 10. In addition, an interval between both stoppers 6*a*, 6*a*** may be adjustable.

The handle mechanism 7 comprises an obstacle 35 as an anchor operation-suppressing means provided below the anchor shaft 15 within the swinging range of the projection 30 of the anchor 14 so as to be often seen, said obstacle 35 being provided with a shaft 36 and supported by inserting said shaft 36 through a support cylinder 37, and the obstacle 35 being energized in a direction of push by means of a coil spring 38. In addition, the shaft 36 is provided with an operating lever 39 pivoted on a base end thereof, said lever 39 being provided with a hanging string 40 mounted thereon. Besides, one of the shores 17, 17 for supporting the anchor 14 is provided with a hole 41, through which the obstacle 35 goes in and out, at a lower end thereof.

In the above described apparatus the obstacle 35 is always projected by an elastic force of the coil spring 38 to be engaged with the projection 30 of the anchor 14, whereby stopping the swing of the anchor 14, and as a result, the pin-roller 20 of the pin-wheel 13 is engaged with any one of the upper guide block 23*a* and the lower guide block 23*b* of the anchor 14 to obstruct the rotation of the pin-wheel 13, so that the controlling device P is not operated and the gondola G is under the suspended condition. So, the sufferers can safely change into the gondola G under the condition that the gondola G is suspended.

The sufferers, who changed into the gondola G, pull down the hanging string 40 and revolve the operating lever 39 to make the obstacle 35 go off the projection 30, whereby releasing the anchor 14 from the suspended condition. And, if the hanging string 40 is continued to be pulled down, the anchor 14 is swung to rotate the pin-wheel 13, whereby the controlling device P is operated to continue the gondola G to descend in a suitable speed, but if a hand is separated from the hanging string 40 or loosened in grip, the ostacle 35 is projected by the elastic force of the coil spring 38 to be engaged with the projection 30, whereby the anchor 14 is suspended, so that the gondola G is stopped to descend. Accordingly, the gondola G can be very easily operated even by ladies and children.

The swing of the anchor 14 is suppressed also by means of the weight 5 and the energy stored in the weight 5 disappears by alternately colliding with the stoppers 6*a*, 6*a*, so that the descending speed of the gondola G is not increased but maintained constant regardless of the descending time, the descending distance and the like. In addition, such a disadvantage that the anchor 14 is twisted about the pin-wheel 13 does not occur. Thus, the controlling device P continues to be safely operated without any troubles.

What is claimed is:

1. An apparatus for escaping from a building on fire comprising;

a body frame provided with a gondola, a pin-wheel rotatably pivoted on said body frame; said pin-wheel being provided with a plurality of pin-rollers projected in the vicinity of an outer circumferential edge of at least one side thereof at predetermined intervals in a circumferential direction and rotatable around an axis parallel to an axis of rotation of the pin-wheel, a rolling drum disposed integrally with said pinwheel; said rolling drum being provided with a rope for hanging said pin-wheel therearound, an anchor hung down under the conditions that one side thereof is closer to said pin-rollers and that it is swingable around an axis shaft line parallel to the axis of rotation of said pin-wheel above said pin-wheel, a weight disposed on a lower end side of said anchor, an inside block positioned on a rotation locus of said pin-rollers under the condition that said anchor is swung and stopped, an guide block disposed outside in a radial direction of said inside guide block to be positioned on the rotation locus of said pin-rollers under the condition that the swing of said anchor is stopped and goes off the rotation locus when said anchor is swung in the direction going away from the rotation axis of the pin-wheel, a projection projected outward from an outside edge of an almost middle portion in the circumferential direction of said anchor, and a pair of stoppers disposed on a movement locus of said projection to control a swinging amplitude of said projection.

2. An apparatus for escaping from a building on fire as defined in claim 1 further comprising an anchor operation-suppressing means adapted to go in and out of the movement locus of the projection of said anchor.

3. An apparatus for escaping from a building on fire as defined in claim 2 wherein said anchor operation-suppressing means comprises a pin going in and out of the movement locus of the projection of said anchor, a spring for always energizing said pin in the direction of the movement locus of the projection of said anchor and an operation lever for going said pin out of the movement locus of the projection of said anchor.

4. An apparatus for escaping from a building on fire as defined in claim 3 wherein a pair of said stoppers include idle rollers and a relative interval therebetween can be regulated.

5. An apparatus for escaping from a building on fire as defined in claim 4 wherein said weight is detachably mounted on said anchor.

6. An apparatus for escaping from a building on fire as defined in claim 4 wherein said inside and outside guide blocks are bent and projected to be an arch-shaped in a state that the center of the arch-shape turns to the central side of rotation of said anchor.

7. An apparatus for escaping from a building on fire as defined in claim 4 wherein said inside and outside guide blocks are formed substantially straight.

* * * * *